US009698503B2

(12) United States Patent
France et al.

(10) Patent No.: US 9,698,503 B2
(45) Date of Patent: Jul. 4, 2017

(54) PART OF A CONDUCTING BAR FOR AN ELECTRICAL APPARATUS

(71) Applicant: ABB TECHNOLOGY AG, Zurich (CH)

(72) Inventors: Philippe France, Chazelles sur Lyon (FR); Andre Imperato, Oullins (FR)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 14/861,957

(22) Filed: Sep. 22, 2015

(65) Prior Publication Data

US 2016/0087355 A1 Mar. 24, 2016

(30) Foreign Application Priority Data

Sep. 23, 2014 (FR) ..... 14 58961

(51) Int. Cl.

| | |
|---|---|
| ***H01R 43/16*** | (2006.01) |
| ***H01R 9/26*** | (2006.01) |
| ***H01R 9/24*** | (2006.01) |
| ***H01R 11/09*** | (2006.01) |
| ***H01R 31/08*** | (2006.01) |

(52) U.S. Cl.

CPC ..... *H01R 9/24* (2013.01); *H01R 11/09* (2013.01); *H01R 31/08* (2013.01); *H01R 9/26* (2013.01); *H01R 43/16* (2013.01)

(58) Field of Classification Search

CPC ..... H01R 13/629; H01R 25/00; H01R 9/24; H01R 9/26; H01R 9/226; H01R 9/2675

USPC ..... 439/707, 709, 725, 733.1, 734, 739

See application file for complete search history.

(56) References Cited

U.S. PATENT DOCUMENTS

| | | | | |
|---|---|---|---|---|
| 5,049,094 A * | 9/1991 | Heng | H02B 1/052 | 439/716 |
| 5,334,054 A * | 8/1994 | Conrad | H01R 9/2691 | 439/716 |
| 5,588,881 A * | 12/1996 | Eggert | H01R 9/2633 | 439/709 |
| 5,816,867 A * | 10/1998 | Davidsz | H01R 4/4818 | 439/828 |
| 6,183,311 B1 * | 2/2001 | Suess | H01R 4/4845 | 439/716 |
| 6,464,545 B2 * | 10/2002 | Yano | H01R 9/26 | 439/441 |
| 6,911,602 B2 * | 6/2005 | Conrad | H01R 9/2691 | 174/68.2 |
| 7,674,140 B2 * | 3/2010 | Eppe | H01R 4/4827 | 439/816 |

(Continued)

FOREIGN PATENT DOCUMENTS

FR 2803441 A1 7/2001

*Primary Examiner* — Harshad Patel
(74) *Attorney, Agent, or Firm* — Cantor Colburn LLP

(57) ABSTRACT

A part (11) of a conducting bar (5) for an electrical apparatus, such as a terminal block, the part (11) of the conductive bar (5) comprising a first planar portion extending along an extension direction (15) of the part (11) of the conducting bar (5), a second planar portion (23) extending along the extension direction (15), the extension plane (25) of the second portion (23) being transversal to the extension plane (21) of the first portion. The part (11) has a first cutout along a first contour arranged in the first portion and a second cutout along a second contour arranged in the first portion.

12 Claims, 2 Drawing Sheets

(56) References Cited

U.S. PATENT DOCUMENTS

| | | | | |
|---|---|---|---|---|
| 8,579,650 | B2 * | 11/2013 | Keswani | H01R 4/4818 439/441 |
| 8,858,269 | B2 * | 10/2014 | Brand | H01R 4/4827 439/733.1 |
| 8,939,800 | B2 * | 1/2015 | Hoppmann | H01R 9/2458 439/513 |
| 8,979,573 | B1 * | 3/2015 | Barber | H01R 4/4836 439/441 |
| 2015/0147907 | A1 * | 5/2015 | Goerlitzer | H01R 9/2625 439/512 |

* cited by examiner

PART OF A CONDUCTING BAR FOR AN ELECTRICAL APPARATUS

CROSS REFERENCE TO RELATED APPLICATION

This application is related to and claims the benefit of French Patent Application Number 14/58961 filed on 23 Sep. 2014, the contents of which are herein incorporated by reference in their entirety.

BACKGROUND

The present invention relates to a part of a conducting bar for an electrical apparatus, such as a terminal block.

It is known to produce conducting bars comprising at least one part originating from a base plate which is cutout then folded. Particularly, it is possible to produce parts of conducting bars comprising two portions extending in the extension direction of said portion. These portions may then be folded along an adjoining edge also extending in the extension direction of said wall.

This allows disposing a part of the conducting bar with a section sufficient for allowing a good electrical conductivity.

The part of the conducting bar further comprises prongs intended to be put in electric contact with a connector coupled to the terminal block.

These prongs are disposed transversally to the extension direction of the part of the conducting bar. They are also remote from each other.

It is known to produce these prongs by folding a part of the base plate. However, several constraints are to be respected, in particular the opening due to the folding of the prong must not lead to weakness points in the electric continuity of the part of the conducting bar.

Enough material must also be disposed for producing the prongs by folding the base plate, for example if the prongs are near the end of the portion along the extension direction thereof.

BRIEF SUMMARY

The present invention aims to resolve all or part of the aforementioned drawbacks.

To this end, the present invention relates to a part of the conducting bar for an electrical apparatus, such as a terminal block, the part of the conducting bar comprising:

- a first planar portion extending along an extension direction of the part of the conducting bar,
- a second planar portion extending along the extension direction of the part of the conducting bar, the extension plane of the second portion being transversal to the extension plane of the first portion,
- a first cutout along a first contour arranged in the first portion, the folding of the first cutout transversally to the extension direction of the part of the conducting bar forming a first contact plug,
- a second cutout along a second contour arranged in the first portion, the folding of the second cutout transversally to the extension direction of the part of the conducting bar forming a second contact plug.

In other words, the part of the conducting bar has a longitudinal extension direction, the first planar portion and the second planar portion extending longitudinally according to the extension direction of the part of the conducting bar, the extension plane of the second portion being transversal to the extension plane of the first portion.

According to an aspect of the invention, the first planar portion is extending according to a determined length along the extension direction of the part of the conducting bar, the second planar portion also extending according to said determined length along the extension direction.

This arrangement allows maintaining a good electrical conductivity along the first opening and along the second opening.

According to an aspect of the invention, the part of the conducting bar further comprises an adjoining edge of the first portion and of the second portion, the adjoining edge extending along the extension direction of the part of the conducting bar.

Being folded, the first cutout and the second cutout are comprised in the first portion. Thus, the first portion includes the material constituting these first and second cutouts.

The presence of the cutouts hence allows saving material during producing the part of the conducting bar.

It thus results a first through opening in the part of the conducting bar along the first contour. A second opening is also defined by the second contour.

The second portion extending along the extension direction of the part of the conducting bar allows maintaining a good electrical conductivity along the first opening and along the second opening.

According to an aspect of the invention the first contour and/or the second contour are open contours.

The first contour and/or the second open contour allow achieving folding of the first and/or the second cutout.

According to an aspect of the invention, a first folding axis of the first cutout is transversal to the extension direction of the part of the conducting bar and/or to which a second folding axis of the second cutout is transversal to the extension direction of the part of the conducting bar.

According to an aspect of the invention, the first contour and the second contour are arranged between the first folding axis and the second folding axis with respect to the extension direction of the part of the conducting bar.

This disposition allows bringing closer the first folding axis and/or the second folding axis of an end of the first portion.

Thus, it is not necessary to provide an additional length beyond an end of the first portion in order to constitute the first and/or the second cutout intended to be folded.

This disposition hence allows obtaining a part of a conducting bar of which the folded cutouts are near to the ends of said portion while not requiring any more material.

Thus, it is possible to produce on a same base plate a plurality of parts of conducting bars while minimizing the off-cuts. In fact, the contour of the first portion may for example be defined in the form of a rectangle.

According to an aspect of the invention, the first contact plug and the second contact plug extend in parallel and transversally to the extension direction of the part of the conducting bar.

In other words, the first contact plug and the second contact plug are disposed in a parallel manner. The first contact plug and the second contact plug are extending transversally to the extension direction of the part of the conducting bar.

According to an aspect of the invention, the first portion and the second portion are produced by folding a planar base.

Preferably, the planar base is folded along the extension direction of the adjoining edge of the first portion with the second portion.

According to an aspect of the invention, the width of the base portion, defined transversally to the extension direction of the part of the conducting bar, is substantially equal to the sum of the widths of the first portion and of the second portion.

Thus, during the manufacturing of the part of the conducting bar, the base portion having to be cut from a plate is substantially rectangular. Thus it is easy to define the disposition of a plurality of base portions on a plate intended to be cutout with the purpose of reducing the material off-cuts.

According to an aspect of the invention, the first contour and the second contour are symmetrical along a plane transversal to the extension direction of the part of the conducting bar.

This symmetry produces contact plugs and openings in the first portion which are identical. No point of the part of the conducting bar thus has a minimum section along the extension direction of the part of the conducting bar. In fact, the openings are identical as they are symmetrical.

This disposition hence allows to not produce a point of weakness in the electrical continuity, the point of weakness generally appearing in the weakest section point of the part of the conducting bar.

According to an aspect of the invention, each contour has two portions extending along the extension direction of the part of the conducting bar.

The first opening and the second opening are thus substantially rectangular. This disposition also participates in maintaining a section substantially constant along the openings along the extension direction of the conducting bar in order to allow a good electrical continuity.

According to an aspect of the invention, the part of the conducting bar comprises a third portion extending along the extension direction of the part of the conducting bar, the extension plane of the third portion being transversal to the extension plane of the first portion.

In other words, the first portion and the third portion are extending longitudinally according to the extension direction of the part of the conducting bar, the extension plane of the third portion being transversal to the extension plane of the first portion.

According to an aspect of the invention, the part of the conducting bar further comprises an adjoining edge of the first portion and of the third portion extending along the extension direction of the part of the conducting bar.

The presence of a third portion allows improving the electrical continuity of the part of the conducting bar.

According to an aspect of the invention, the first portion, the second portion and the third faction are produced by folding the portion with the planar base along the extension direction of the adjoining edge of the first portion with the second portion and along the extension direction of the adjoining edge of the first portion with the third portion.

According to an aspect of the invention, the second portion and the third portion have the same angle with respect to the first portion transversally to the extension direction of the part of the conducting bar.

According to an aspect of the invention, the second portion and the third portion extend in parallel.

The present invention also relates to a conducting bar comprising a part of conducting bar such as described above.

The present invention further relates to a terminal block comprising a conducting bar such as described above.

BRIEF DESCRIPTION OF THE DRAWINGS

Anyway, the invention will be better understood by means of the following description with reference to the accompanying schematic drawings representing, by way of non limiting example, an embodiment of this part of conducting bar.

DETAILED DESCRIPTION

Figure 1:
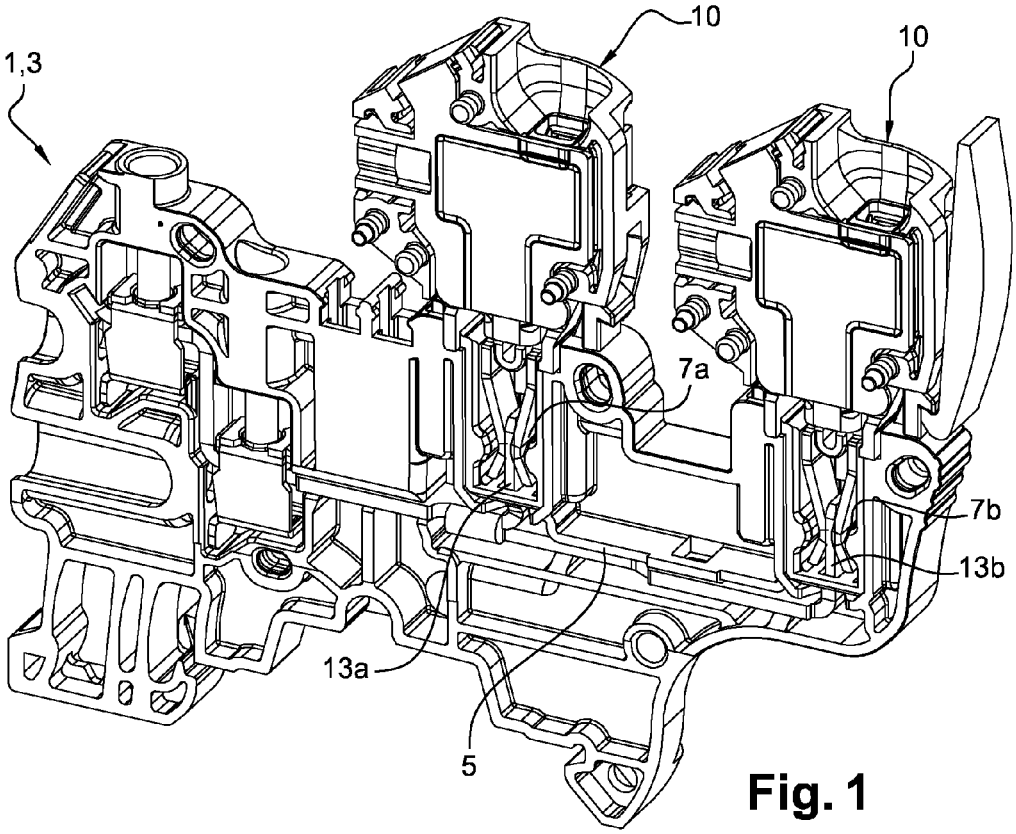
FIG. 1 is a schematic view of a terminal block comprising a conducting bar.

As illustrated on FIG. 1, an electrical apparatus 1 such as a terminal block 3 comprises a conducting bar 5. The terminal block 3 has two insertion orifices 7*a*, 7*b*, each arranged for receiving a conductor. Connectors 10 are coupled to the terminal block 3.

The conducting bar 5 comprises a part 11 having two contact plugs 13*a*, 13*b* arranged to be in contact when a conductor is inserted in the corresponding insertion orifice 7*a*, 7*b*.

Figure 2:
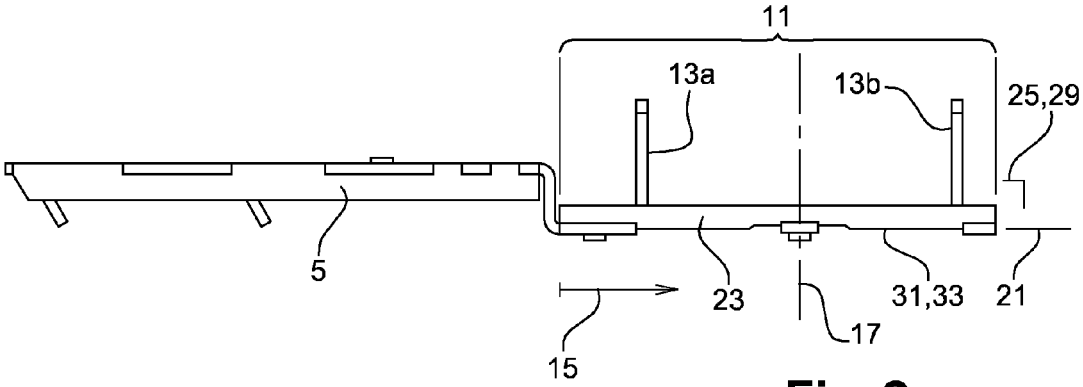
FIG. 2 is a front view of the conducting bar.
Figure 3:
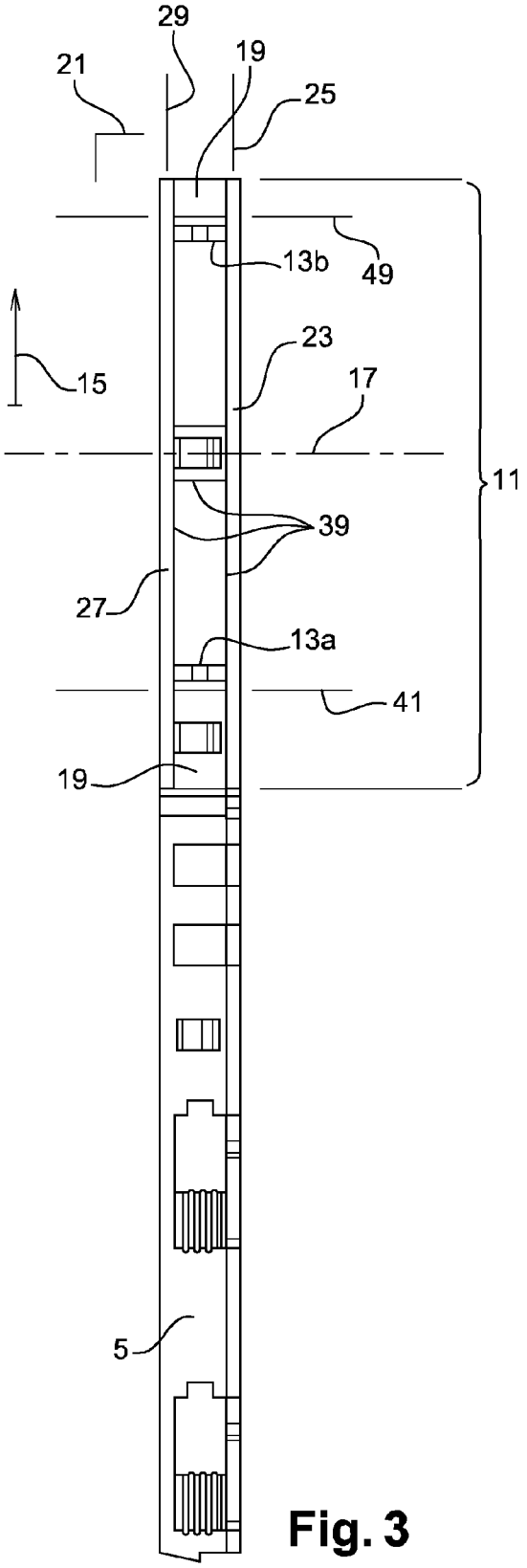
FIG. 3 is a top view of the conducting bar.

As illustrated on FIGS. 2 and 3, the part 11 of the conducting bar 5 has a longitudinal extension direction 15 according to a determined length as depicted by reference 11 in FIG. 3, the first contact plug 13*a* and the second contact plug 13*b* extending transversally to the extension direction 15 of the part 11 of the conducting bar 5.

The first contact plug 13*a* and the second contact plug 13*b* are also disposed in a parallel manner and are symmetrical with respect to a plane 17 transversal to the extension direction 15 of the part 11 of the conducting bar 5.

The part 11 of the conducting bar 5 comprises a first planar portion 19 extending along a first plane 21, a second planar portion 23 extending along a second plane 25 and a third planar portion 27 extending along a third plane 29. Each portion 19, 23, 27 are extending according to the determined length along the extension direction 15.

The second plane 25 and the third plane 29 are parallel and both perpendicular to the first plane 21. The part 11 of the conducting bar 5 comprises an adjoining edge 31 of the first portion 19 with the second portion 23 and an adjoining edge 33 of the first portion 19 with the third portion 27. The adjoining edges 31, 33 extend along the extension direction 15 of the part 11 of the conducting bar 5.

Figure 4:
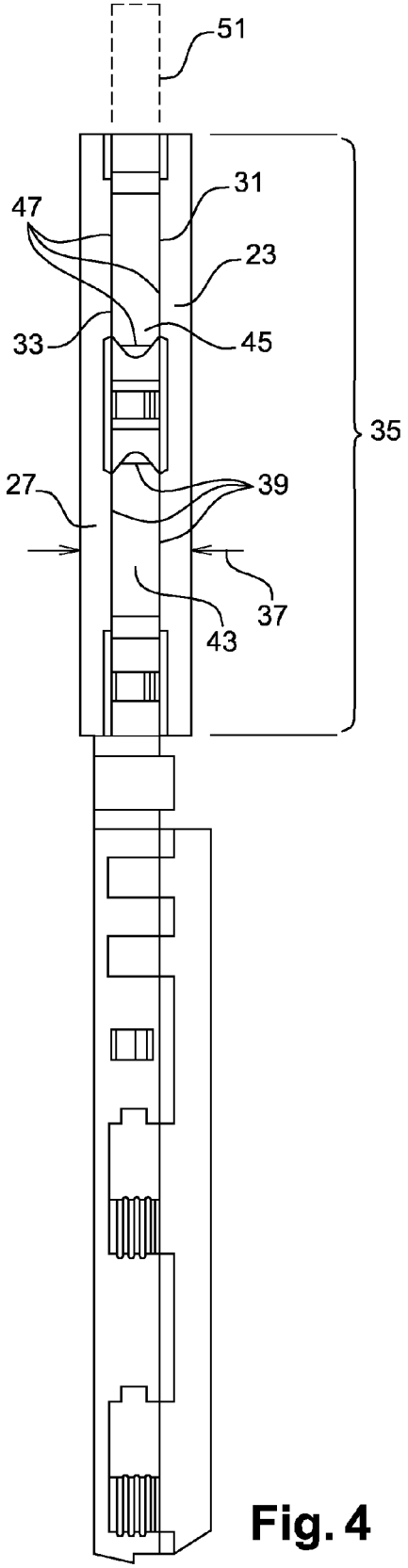
FIG. 4 is a top view of a planar base from which the conducting bar originates.

As illustrated on FIG. 4, the first portion 19, the second portion 23 and the third portion 27 originate from a same planar base 35. The base 35 is a cutout plate, the part 11 of the conducting bar 6 having been obtained by folding along the extension directions of the adjoining edges 31, 33.

It thus appears that the width 37 of the base 35, defined transversally to the extension direction 15 of the part 11 of the conducting bar 5, substantially corresponds to the sum of the widths of the first portion 19, of the second portion 23 and of the third portion 27.

The first contact plug 13*a* and the second contact plug 13*b* both originate from the first portion 19.

A first cutout 43 along a first open contour 39 is produced in the planar base 35. This first open contour 39 has a rectangular form, the first cutout 43 being produced over two lengths and a width of the rectangle.

A first folding axis 41 is defined as being substantially superimposed to the width of the non cutout rectangle. The first contact plug 13*a* hence originates from folding the first cutout 43 of the first portion 19. The first cutout 43 is defined as being the inner part to the first contour 39.

The second contact plug 34*b*, similarly, originates from folding a second inner cutout 45 to a second open contour 47. Then are also achieved the second cutout 45 then a folding along a second folding axis 49.

The comparison of the part 11 of the conducting bar 5 and the base 35 of which the part 11 of the conducting bar 5 originates allows distinguishing the advantages of the present invention.

The base 35 is substantially rectangular. This allows an easy disposition on a plate in which a plurality of bases 35 must be cut out. The plate off-cuts are thereby reduced.

In fact, the orientation of the second contour 47 producing the second contact plug 13*b* does not go over the rectangular shape of the base 35.

This is due to the disposition of the first contour 39 and the second contour 47 which produces the contact plugs 13*a*, 13*b*. The fact that these cutouts 43, 45 are symmetrical with respect to a transversal plane 17 allows maintaining the rectangular shape of the base while obtaining a part 11 of the conducting bar 5 of which the contact plugs 13*a*, 13*b* are spaced apart sufficiently to be suitable for the terminal block 3.

In fact, if the cutouts were produced in the same direction along the extension direction 15 of the part 11 of the conducting bar 5, the base 35 would have an extension 51 outside the current contour of the base 35 as represented in dots on FIG. 4.

As it is known per se, the invention is not limited to the sole embodiment of this part of the conducting bar, described above by way of example, it encompasses all the variants.

The invention claimed is:

1. A part of a conducting bar for an electrical apparatus, the part of the conducting bar comprising:

a first portion being planar according to an extension plane of the first portion and extending along an extension direction of the part of the conducting bar, a second portion being planar according to an extension plane of the second portion and extending along the extension direction of the part of the conducting bar, the extension plane of the second portion being transversal to the extension plane of the first portion, the first portion extending according to a determined length along the extension direction of the part of the conducting bar and the second portion also extending according to said determined length along the extension direction, a first cutout along a first contour arranged in the first portion, a folding of the first cutout transversally to the extension direction of the part of the conducting bar forming a first contact plug, a second cutout along a second contour arranged in the first portion, a folding of the second cutout transversally to the extension direction of the part of the conducting bar forming a second contact plug.

2. The part of a conducting bar according to claim 1, wherein the first contour and/or the second contour are open contours.

3. The part of a conducting bar according to claim 1, wherein a first folding axis of the first cutout is transversal to the extension direction of the part of the conducting bar and/or wherein a second folding axis of the second cutout is transversal to the extension direction of the part of the conducting bar.

4. The part of a conducting bar according to claim 3, wherein, the first contour and the second contour are arranged between the first folding axis and the second folding axis with respect to the extension direction of the part of the conducting bar.

5. The part of a conducting bar according to claim 1, wherein the first contact plug and the second contact plug extend in parallel and transversally to the extension direction of the part of the conducting bar.

6. The part of a conducting bar according to claim 1, wherein the first portion and the second portion are produced by folding a planar base.

7. The part of a conducting bar according to claim 1, wherein the first contour and the second contour are symmetrical along a plane transversal to the extension direction of the part of the conducting bar.

8. The part of a conducting bar according to claim 7, wherein, each contour has two portions extending along the extension direction of the part of the conducting bar.

9. The part of a conducting bar according to claim 1, comprising a third portion extending along the extension direction of the part of the conducting bar, the extension plane of the third portion being transversal to the extension plane of the first portion.

10. The part of a conducting bar according to the preceding claim 9, wherein the second portion and the third portion have the same angle with respect to the first portion transversally to the extension direction of the part of the conducting bar.

11. A conducting bar comprising a part of a conducting bar according to claim 1.

12. A terminal block comprising a conducting bar according to claim 11.

* * * * *